US006772521B2

(12) United States Patent
Nordlin et al.

(10) Patent No.: US 6,772,521 B2
(45) Date of Patent: Aug. 10, 2004

(54) HYDRAULIC PUNCH DRIVER

(75) Inventors: William F. Nordlin, Poplar Grove, IL (US); Thomas Gene Boese, Rockford, IL (US)

(73) Assignee: Greenlee Textron Inc., Rockford, IL (US)

( * ) Notice: Subject to any disclaimer, the term of this patent is extended or adjusted under 35 U.S.C. 154(b) by 209 days.

(21) Appl. No.: 10/074,535

(22) Filed: Nov. 13, 2001

(65) Prior Publication Data

US 2002/0112353 A1 Aug. 22, 2002

Related U.S. Application Data

(60) Provisional application No. 60/259,947, filed on Jan. 5, 2001.

(51) Int. Cl.[7] ..... B26F 1/00
(52) U.S. Cl. ..... 30/360; 30/362
(58) Field of Search ..... 30/360, 362, 228; 81/177.7, 177.8; 173/171

(56) References Cited

U.S. PATENT DOCUMENTS

| | | | | |
|---|---|---|---|---|
| 1,325,407 A | | 12/1919 | Morgan | |
| 2,297,160 A | | 9/1942 | Nally | |
| 2,529,895 A | | 11/1950 | Anderson | |
| 2,787,179 A | | 4/1957 | Warner | |
| 3,105,299 A | | 10/1963 | Wirtanen | |
| 3,380,160 A | * | 4/1968 | Kirchberger et al. | 30/162 X |
| 4,006,784 A | | 2/1977 | Dudek | |
| 4,495,699 A | | 1/1985 | Oakes | |
| 4,922,615 A | | 5/1990 | Nishida | |
| 5,416,975 A | | 5/1995 | Saito et al. | |
| 5,598,635 A | | 2/1997 | Saito | |
| 6,266,886 B1 | | 7/2001 | Tandart | |

OTHER PUBLICATIONS

Three (3) pages from Greenlee Product Catalog Copyright 1999,
Two (2) pictures of a Black & Decker Mixing Tool, date unknown.

* cited by examiner

*Primary Examiner*—Douglas D Watts
(74) *Attorney, Agent, or Firm*—Trexler, Bushnell, Giangiorgi, Blackstone & Marr, Ltd.

(57) ABSTRACT

A hydraulic punch driver which includes a hydraulic pump section a hydraulic ram section, and a hydraulic hose which connects these two sections together. Because the hydraulic hose is flexible, the operator is able to manipulate the ram section such that it can be positioned at an angle relative to the pump section; a hose guard can be provided on the hose to protect the hose and to prevent overflexing of the hose. Such flexibleness allows the operator to use the punch driver in virtually any position such that the ram can operate as necessary and the operator can operate the pump handle, regardless of the environmental conditions of the place of use. The pump section also includes a coupler which allows a handle thereof to swivel 360 degrees to further allow the operator to grip and actuate the pump handle with maximum comfort.

19 Claims, 6 Drawing Sheets

HYDRAULIC PUNCH DRIVER

CROSS-REFERENCE

This patent application claims the benefit of domestic priority of U.S. Provisional Application Ser. No. 60/259,947, filed Jan. 5, 2001, and entitled "Improved Hydraulic Punch Driver".

BACKGROUND OF THE INVENTION

The present invention relates to an improved portable hydraulic punch driver which is used to punch holes in sheet metal or, for example, in the walls of electrical cabinets.

Generally, when a hole is to be punched in an electrical cabinet, a small hole is first drilled in the wall of the electrical cabinet. A first end of a draw stud is threaded into a ram of a hydraulic punch driver. A second end of the draw stud is inserted through a punching die and then through the drilled hole, the draw stud having a circumference that is less than the circumference of the drilled hole. A punch is threaded onto the second end of the draw stud on the opposite side of the electrical cabinet than is the punching die and the hydraulic punch driver.

An operator actuates a hand pump of the hydraulic punch driver. When the hand pump of the hydraulic punch driver is actuated, hydraulic fluid forces the ram to pull the draw stud. The draw stud, in turn, pulls the punch through the electrical cabinet into the die such that the desired hole size is punched. Once the hole is punched, a release knob permits the ram and the hydraulic fluid to go back to their original positions.

The problem with such tools, though, is that due to the confined spaces that are often present near electrical cabinets, the hydraulic punch driver may not fit into the area where it must make the punch, or an operator may not be able to get his or her hand/arm into the area to actuate the handle of the punch driver. Thus, in the past, operator's had to have a plurality of tools to overcome this problem. For instance, the operator may have at his or her disposal a straight hydraulic driver, such as a GREENLEE® 7804-M4, and a 90 degree hydraulic driver, such as a GREENLEE® 7904-M4, both of which are owned by the assignee of the present invention. Both of these hydraulic drivers have 360 degree swivel handles which make it easier for the operator to actuate the handle. Both of these tools, however, do not allow for any other angles between 0 and 90 degrees to be achieved.

Thus, there is a need for a hydraulic punch driver that can be manipulated at any angle from 0 to 90 degrees and that has a swivel handle that can be rotated 360 degrees. Such a hydraulic punch driver would give the operator the flexibility that he or she would need to operate the punch driver under almost any work environment conditions. The present invention provides such a hydraulic punch driver. Other features and advantages of the hydraulic punch driver of the present invention will become apparent upon a reading of the attached specification in combination with a study of the drawings.

OBJECTS AND SUMMARY OF THE INVENTION

A primary object of the invention is to provide an all purpose hydraulic punch driver that will allow an operator to use a single punch driver for any type of punch needed in any type of environmental condition.

Another object of the invention is to provide a hydraulic punch driver wherein the ram section of the hydraulic punch driver can be rotated from 0 to 90 degrees in relation to the pump section of the hydraulic punch driver.

Yet another object of the invention is to provide a hydraulic punch driver that has a handle portion that can swivel 360 degrees.

Still another object of the invention is to provide a hydraulic punch driver which is compact and lightweight.

A further object of the invention is to provide a hydraulic punch that replaces the two separate tools, both a straight punch driver and a 90 degree punch driver, that were previously used.

Briefly, and in accordance with the foregoing, the present invention provides a novel hydraulic punch driver. The hydraulic punch driver includes much of the generally known structure of prior art hydraulic punch drivers, i.e., a hydraulic pump section including a pump handle, and a hydraulic ram section. In the prior art punch drivers, the hydraulic pump sections and the hydraulic ram sections are directly connected to each other. The present invention provides a hydraulic punch driver wherein the hydraulic pump section is not directly connected to the hydraulic ram section, but rather, these two sections are connected together by an elongated, flexible, but durable, hydraulic hose. Because the hydraulic hose is flexible, the operator is able to manipulate the hydraulic ram section such that it can be positioned at any angle from 0 to greater than 90 degrees relative to the hydraulic pump section. Such flexibleness of the hose allows the operator to use the hydraulic punch driver in any position such that the ram can operate as necessary and the operator can operate the pump handle, regardless of the environmental conditions of the place of use, i.e., confined spaces often present near electrical cabinets. The pump handle of the punch driver also advantageously swivels 360 degrees relative to the hose to further allow the operator to grip and actuate the pump handle with maximum comfort. A hose guard can also be provided around the hose which prevents the hose from damage caused by impacts and sharp objects and which further prevents the hose from being overflexed, i.e., flexed past 90 degrees relative to the hydraulic pump section.

BRIEF DESCRIPTION OF THE DRAWINGS

The features of the present invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENT

Figure 1:
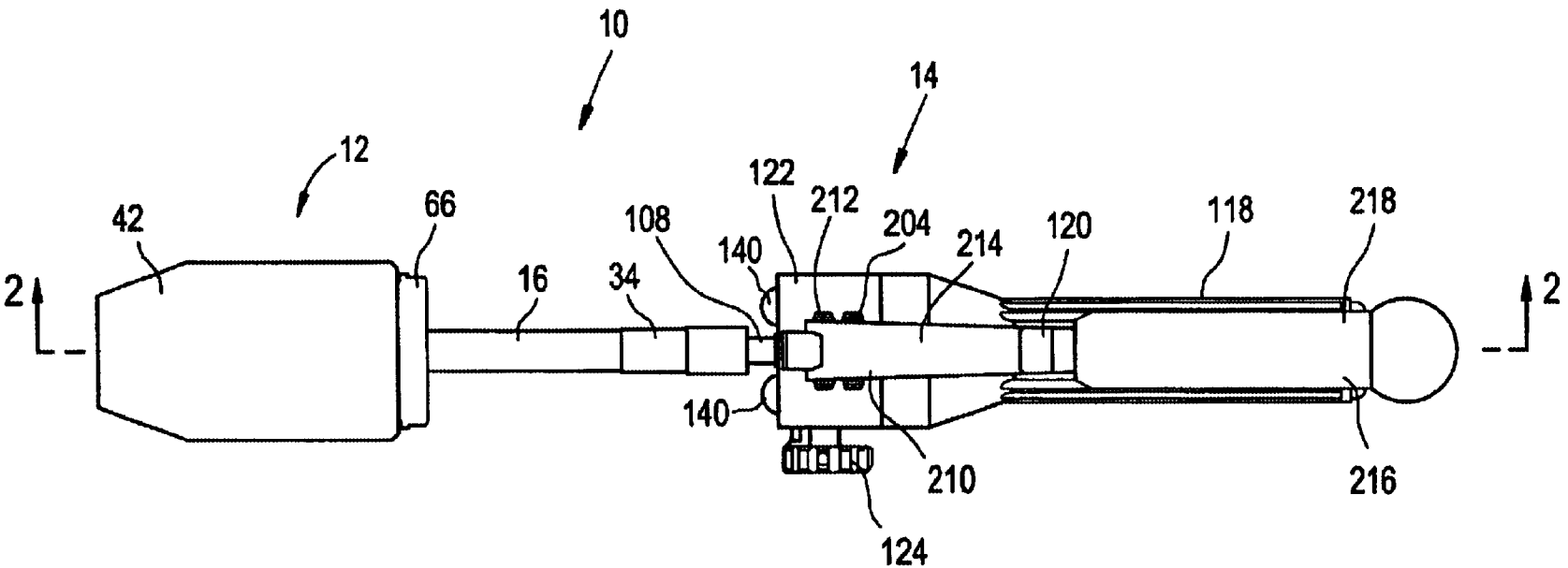
FIG. 1 is a top plan view of a hydraulic punch which incorporates the features of the invention.

While this invention may be susceptible to embodiment in different forms, there is shown in the drawings and will be described herein in detail, a specific embodiment with the understanding that the present disclosure is to be considered an exemplification of the principles of the invention, and is not intended to limit the invention to that as illustrated.

Figure 2:
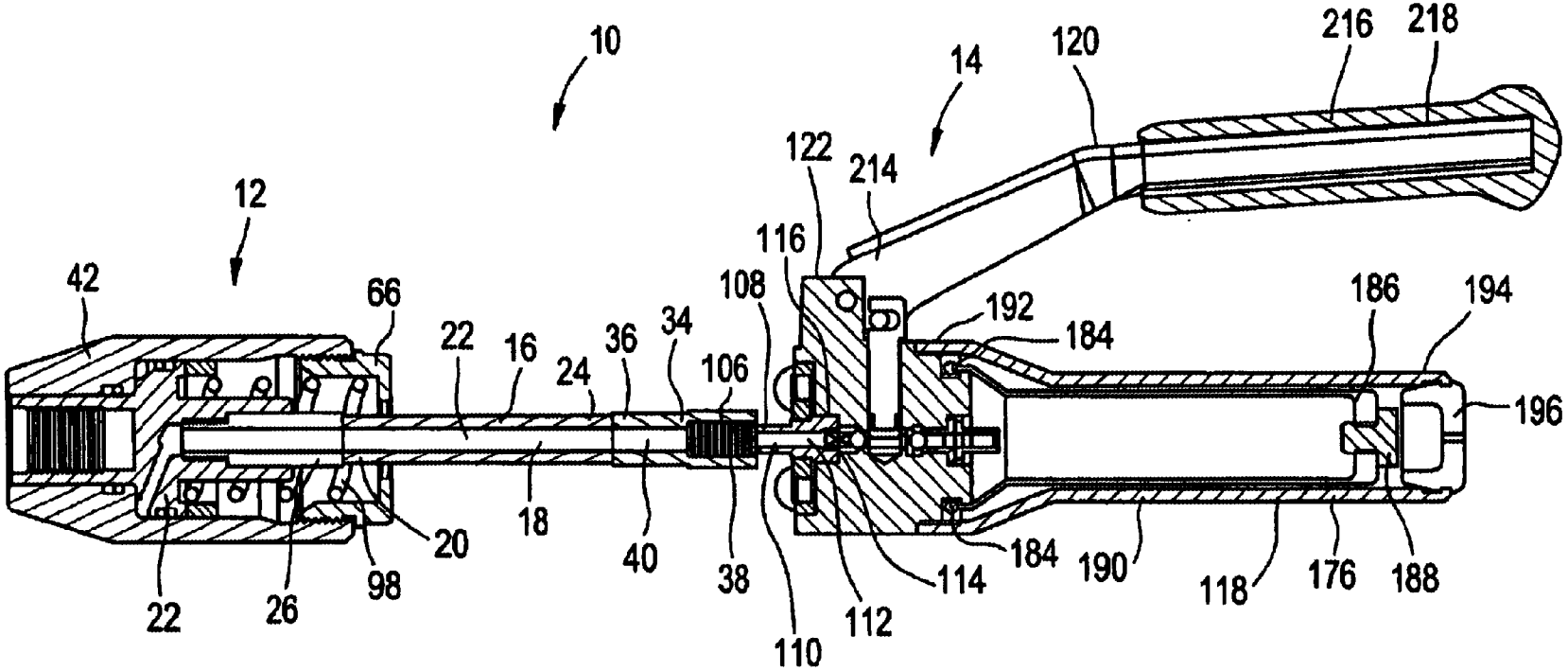
FIG. 2 is a cross-sectional view of the hydraulic punch taken along line 1—1 of FIG. 1.

As shown in FIGS. 1 and 2, the hydraulic punch 10 of the present invention includes a hydraulic ram section 12 (which can be seen in detail in FIG. 3) and a hydraulic pump section 14 (which can be seen in detail in FIG. 4) which are separated from, and connected to, one another by an elongated, flexible and durable hydraulic hose 16.

The hydraulic hose 16 has a bore 18 that extends therethrough from a first end 20 of the hose 16, through a middle portion 22 of the hose 16, to a second end 24 of the hose 16. The hydraulic hose 16 is preferably a product sold by Parker under the catalog number 431 Compact®, which is a synthetic rubber tube, two braids of high tensile steel wire reinforcement, and MSHA accepted synthetic rubber cover.

A first hydraulic hose connector 26 having first and second ends 28, 30 is connected to the first end 20 of the hose 16 at the second end 30 thereof. The first hydraulic hose connector 26 is externally threaded at the first end 28 and has an axial bore 32 therethrough such that the axial bore 32 of the first hydraulic hose connector 26 communicates with the axial bore 18 of the hydraulic hose 16.

A second hydraulic hose connector 34 having first and second ends 36, 38 is connected to the second end 24 of the hose 16 at the first end 36 thereof. The second hydraulic hose connector 34 is internally threaded at the second end 38 and has an axial bore 40 therethrough such that the axial bore 40 of the second hydraulic hose connector 34 communicates with the axial bore 18 of the hydraulic hose 16.

Figure 3:
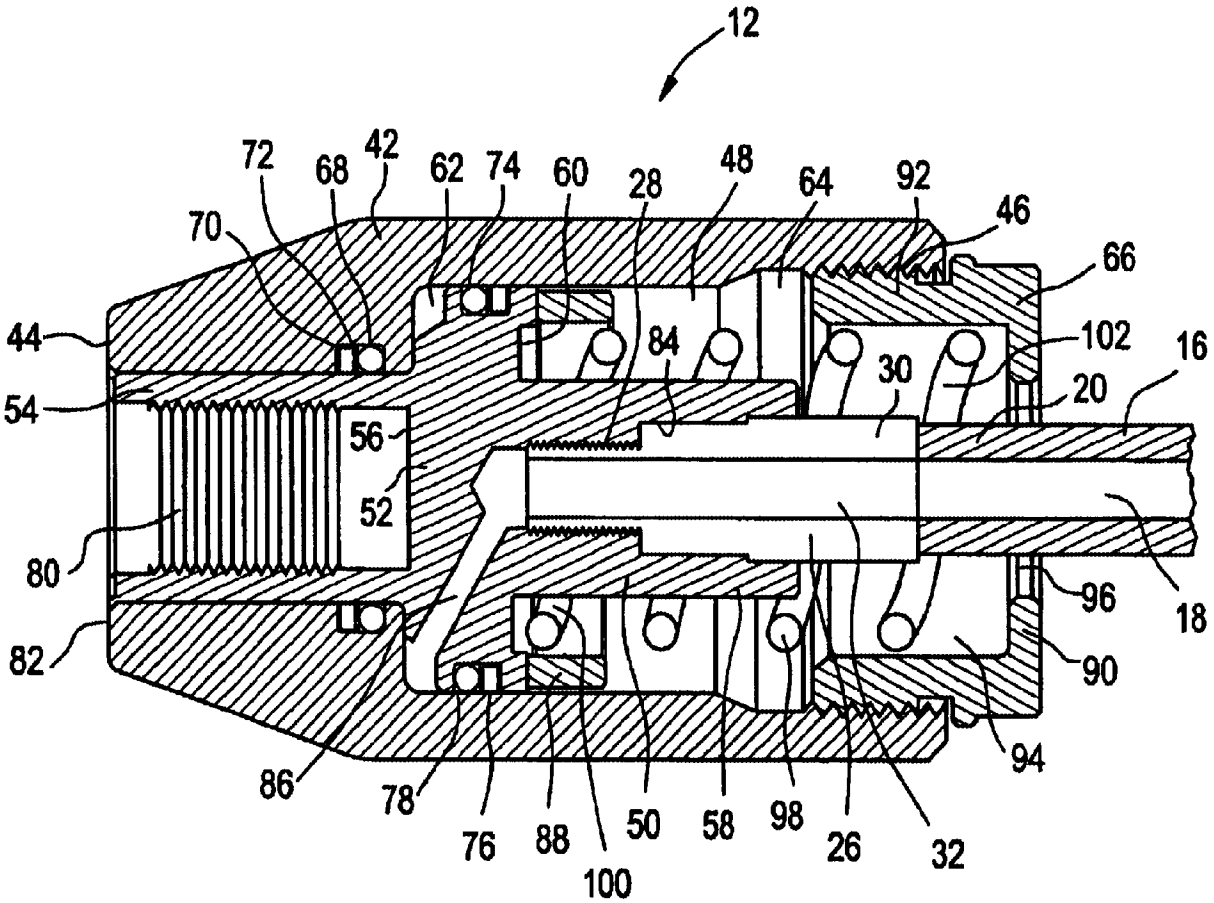
FIG. 3 is a cross-sectional view of a hydraulic ram section of the hydraulic punch, a flexible hose connector and a portion of a flexible hose.

As shown in FIG. 3, the hydraulic ram section 12 has a housing 42 having first and second ends 44, 46 and a passageway 48 therethrough. A ram 50 is contained within the passageway 48 of the housing 42 and is mounted to slide within the passageway 48.

The ram 50 is formed of a central body 52 mounted to slide in the passageway 48, a first portion 54 extending from a first side 56 of the central body 52 to the first end 44 of the housing 42 and a second portion 58 extending from a second side 60 of the central body 52 toward the second end 46 of the housing 42. The central body 52, the first portion 54 and the second portion 58 are all preferably made from a single piece of material.

A first chamber 62 is defined by the central body 52, the first portion 54 (during actuation as discussed herein) and the housing 42. A second chamber 64 is defined by the central body 52, the second portion 58, a spring retainer 66, the flexible hydraulic hose 16 and the housing 42. Sealing between the housing 42 and the first portion 54 of the ram 50 is provided by means of O-ring 68 and annular ring 70. O-ring 68 and annular ring 70 are retained in a gap 72 provided in the housing 42 between the housing 42 and the first portion 54 of the ram 50. Sealing between the first and second chambers 62, 64 is provided by means of O-ring 74 and annular ring 76. O-ring 74 and annular ring 76 are retained in a gap 78 provided in the central body 52 of the ram 50 between the housing 42 and the central body 52 of the ram 50.

The first portion 54 has a cavity 80 therein and is internally threaded. The first portion 54 further opens axially to the outside of a first end 82 of the hydraulic ram section 12.

The second portion 58 has an axial bore 84 therein which is at least partially internally threaded for connecting the second portion 58 to the external threading of the first hydraulic hose connector 26. The axial bore 84 in the second portion 58 communicates with both a radial bore 86 which opens into the first portion 54 and the axial bore 32 of the first hydraulic hose connector 26. The radial bore 86 is formed within the central body 52 of the ram 50.

A ram spacer 88 is also provided in the hydraulic ram section 12. The ram spacer 88 is an annular piece that extends completely around and is spaced from the second portion 58 of the ram 50. The ram spacer 88 abuts against the central body 52 of the ram 50. The ram spacer 88 ensures that the ram 50 does not slide too far within the second chamber 64.

The spring retainer 66 is also provided in the hydraulic ram section 12. The spring retainer 66 is formed from an end wall 90 having an annular skirt 92 depending therefrom. The exterior surface of the skirt 92 has threading thereon to mate with internal threading of the housing 42 at the second end 46 of the housing 42. A chamber 94 is defined within the spring retainer 66 and is in communication with the second chamber 64. The end wall 90 has an opening 96 therethrough which is smaller in diameter than the chamber 94.

A normally expanded spring 98 is provided within chambers 64 and 94. The spring 98 is positioned within the second chamber 64, around the second portion 58, the first hydraulic hose connector 26 and the hose 16. A first end 100 of the spring 98 is positioned proximate to the central body 52 and within the ram spacer 88 and a second end 102 of the spring 98 is positioned within the chamber 94 proximate to the end wall 90 of the spring retainer 66.

The second end 30 of the first hydraulic hose connector 26 extends beyond the second portion 58 and extends into the chamber 94 of the spring retainer 66. The second end 30 of the first hydraulic hose connector 26 is positioned within the spring 98. The first end 20 of the hydraulic hose 16 that is connected to the first hydraulic hose connector 26 is positioned within the chamber 94 of the spring retainer 66 and is positioned within the spring 98. The hydraulic hose 16 further extends through the opening 96 in the end wall 90 of the spring retainer 66, and thus, extends outside of the hydraulic ram section 12.

As shown in FIG. 2, the middle portion 22 of the hydraulic hose 16 extends outside of the hydraulic ram section 12. The middle portion 22 of the hydraulic hose 16 is free to bend at any angle from 0 degrees to an angle greater than 90 degrees as the hydraulic hose 16 is made of a flexible material.

As the second hydraulic hose connector 34 is internally threaded at the second end 38 thereof, a first end 106 of a ram coupler 108, which is externally threaded, can be attached thereto. The ram coupler 108 is a component of the hydraulic pump section 14, which will be discussed in more detail herein. The axial bore 40 of the second hydraulic hose connector 34 communicates with an axial bore 110 of the ram coupler 108.

The axial bore 110 of the ram coupler 108 has a first portion 112 having a first diameter proximate to the first end 106 of the ram coupler 108 and a second portion 114 having a second diameter, which is slightly larger than the first diameter of the first portion 112, proximate to a second end 116 of the ram coupler 108.

Figure 4:
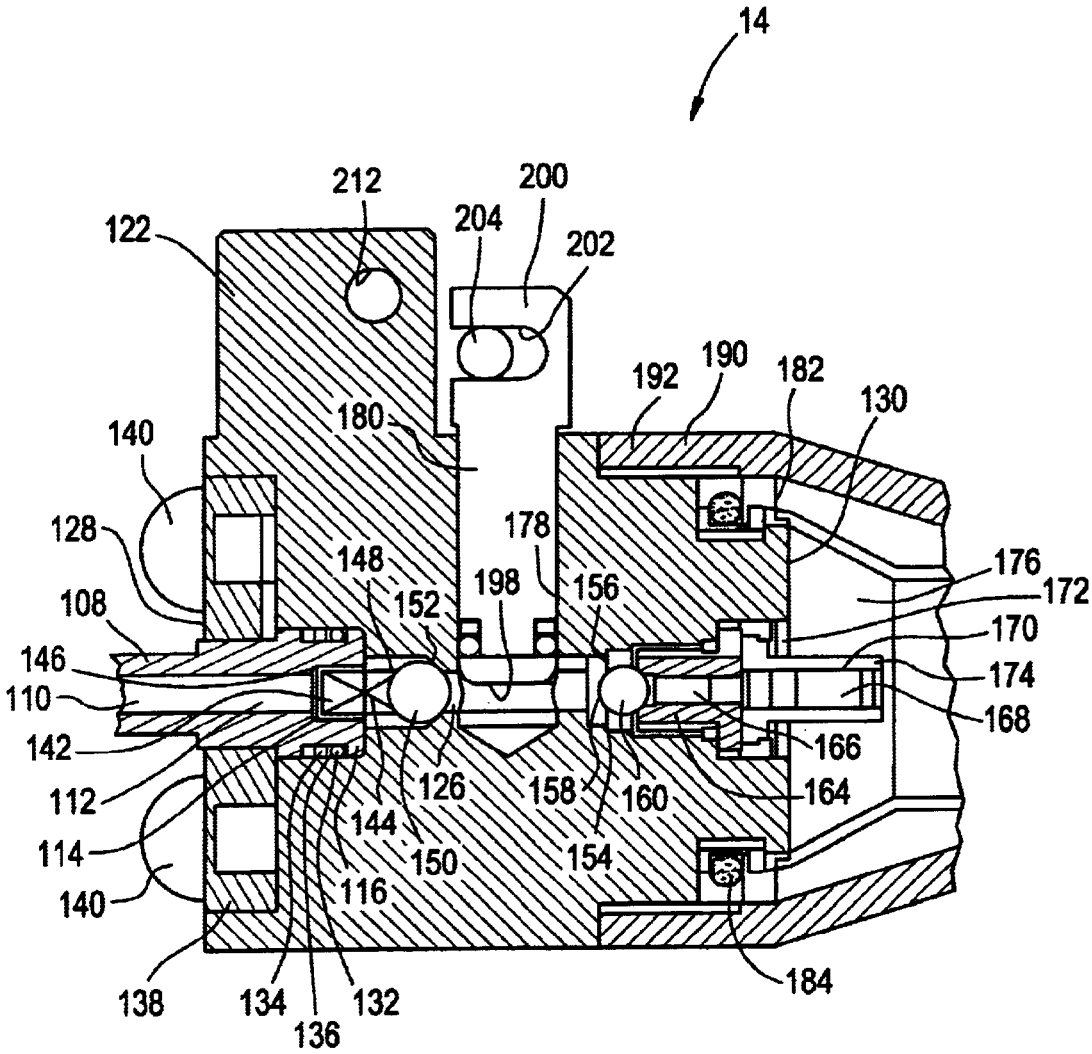
FIG. 4 is a cross-sectional view of the hydraulic pump section of the hydraulic punch.

As shown in FIGS. 1 and 2, the hydraulic pump section 14 also includes a reservoir handle 118, a pump handle 120, a pump block 122 and a knob 124. As best illustrated in FIG. 4, the pump block 122 has an axial bore 126 therethrough which extends from a first side 128 of the pump block 122 to a second side 130 of the pump block 122. The axial bore 126 at the first side 128 of the pump block 122 accepts the second end 116 of the ram coupler 108 such that the axial bore 110 of the ram coupler 108 communicates with the axial bore 126 of the pump block 122. The ram coupler 108 is sealingly connected to the pump block 122 by an O-ring 132 and an annular ring 134. The O-ring 132 and the ring 134 rest in a cavity 136 of the ram coupler 108 between the ram coupler 108 and the pump block 122.

A retaining plate 138 is also positioned around the ram coupler 108 to connect the ram coupler 108 to the pump block 122. The retaining plate 138 is secured to the pump block 122 by fastening means 140, preferably screws. The retaining plate 138 retains the ram coupler 108 within the pump block 122 because the ram coupler 108 has a larger diameter at its second end 116 where it is sealed to the pump block 122 than near its first end 106 where the retaining plate 138 is positioned around the ram coupler 108.

A first end 142 of a normally expanded spring 144 extends into the axial bore 110 of the ram coupler 108 at its second end 116 and abuts against a shoulder 146 within the bore 110 of the ram coupler 108. A second end 148 of the normally expanded spring 144 extends into the axial bore 126 of the pump block 122 and abuts against a ball 150. The ball 150, due to the normally expanded spring 144, is forced against a first shoulder 152 of the pump block 122 at which the diameter of the axial bore 126 of the pump block 122 decreases.

The axial bore 126 of the pump block 122 extends past the ball 150 toward the second side 130 of the pump block 122. Prior to reaching the second side 130 of the pump block 122, the diameter of the axial bore 126 increases such that a second shoulder 154 is provided. A flexible retaining ring 156 having a passageway 158 therethrough rests against the second shoulder 154 and a ball 160 partially rests in the passageway 158 of the retaining ring 156. The opposite side of the ball 160 abuts against a seat 164 such that the ball 160 seals an axial bore 166 of the seat 164.

The axial bore 166 of the seat 164 is in communication with an axial bore 168 of an oil filter 170. The oil filter 170 and the seat 164 are retained within the axial bore 126 of the pump block 122, proximate to the second side 130 of the pump block 122, by a retaining ring 172. The oil filter 170 has an end 174 that extends into a bladder 176 such that the axial bore 168 of the oil filter 170 is in communication with the bladder 176. A reservoir is provided in the bladder 176.

The bladder 176 is connected to the pump block 122 at a first end 182 thereof by annular ring 184. A second end 186 of the bladder 176 is closed by a bladder plug 188 as shown in FIG. 2. The bladder 176 houses hydraulic fluid in its reservoir. The bladder plug 188 is removable such that hydraulic fluid can be replaced in the bladder 176 if necessary.

A housing 190 extends completely around the bladder 176. The housing 190 is connected to the pump block 122 at a first end 192 thereof by suitable means. A second end 194 of the housing 190 is closed by a cap 196. The cap 196 is removable such that the bladder plug 188 can be removed to replace hydraulic fluid if necessary. The housing 190 further provides extra protection from the leaking of hydraulic fluid should the bladder 176 leak hydraulic fluid.

A bore 178 is provided in the pump block 122 and is perpendicular to the axial bore 126 of the pump block 122. The bore 178 is provided between the ball 150 and the ball 160. The bore 178 houses a plunger 180.

The plunger 180 is contained within the bore 178 in the pump block 122 and has a first end 198 which is capable of extending through the axial bore 126 so as to block fluid flow through the axial bore 126. The second end 200 of the plunger 180 extends outwardly from the pump block 122 and has an oblong notch 202 therein. The oblong notch 202 houses a pin 204 which connects two arms (not shown) of an end yoke 210 of the pump handle 120 together. The pin 204 is capable of moving within the notch 202 during movement of the pump handle 120.

A first end 214 of the pump handle 120 is attached to the pump block 122 by a pivot pin 212. The pump handle 120 can pivot about the pivot pin 212 between two extreme positions, namely a first position in which it extends more or less parallel to the housing 190 (as shown in FIG. 2), and a second position in which the pump handle 120 is approximately perpendicular to the housing 190 (not shown), the function of which will be described herein. A grip 216 can also be positioned around a second end 218 of the pump handle 120 if desired.

The release knob 124 is of a generally known construction and is also provided on the pump block 122. When the release knob 124 is operated, hydraulic fluid is returned through the hydraulic ram section 12, through the flexible hydraulic hose 16, into the pump block 122 and into the bladder 176 of the reservoir handle 118.

Figure 5:
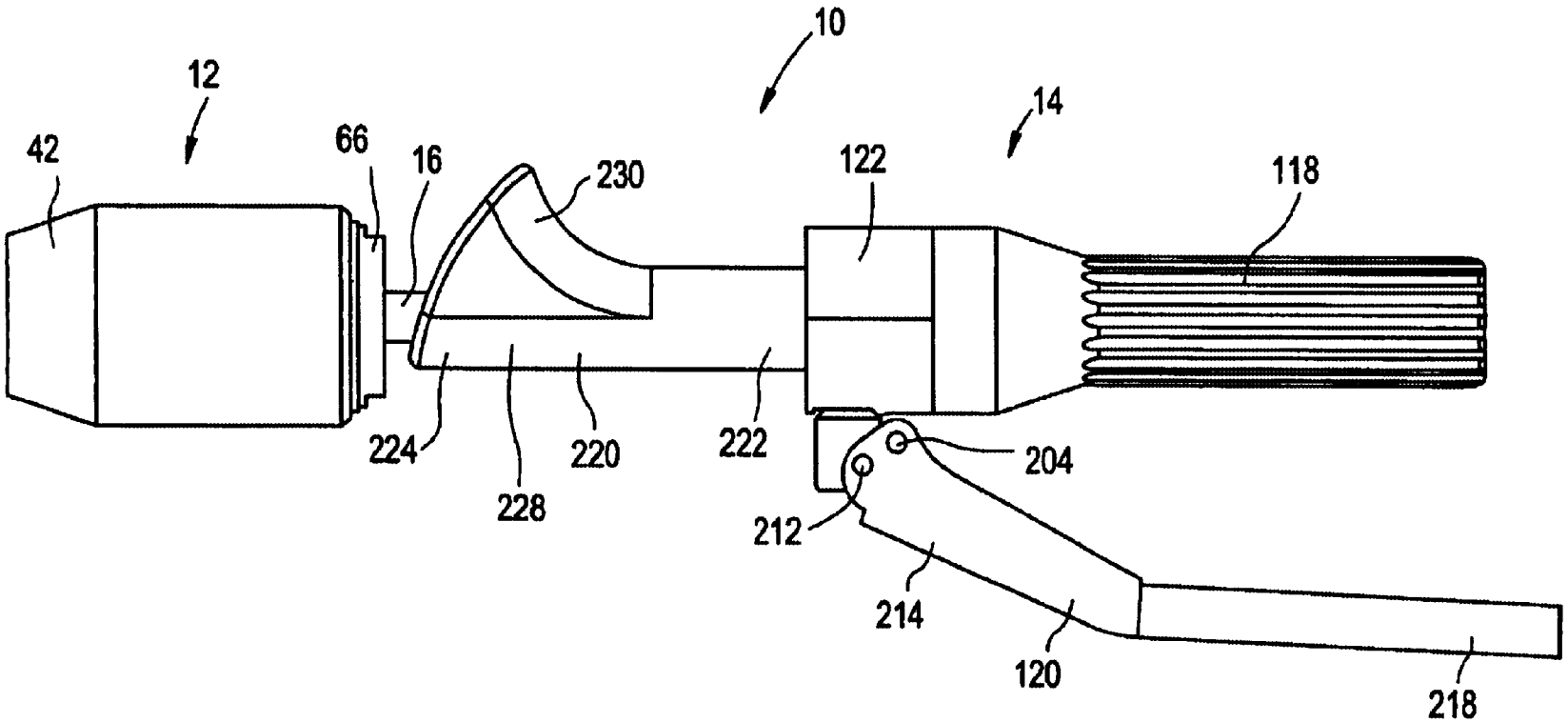
FIG. 5 is a side elevational view of the hydraulic punch of FIG. 1 which further includes a hose guard of the present invention.
Figure 6:
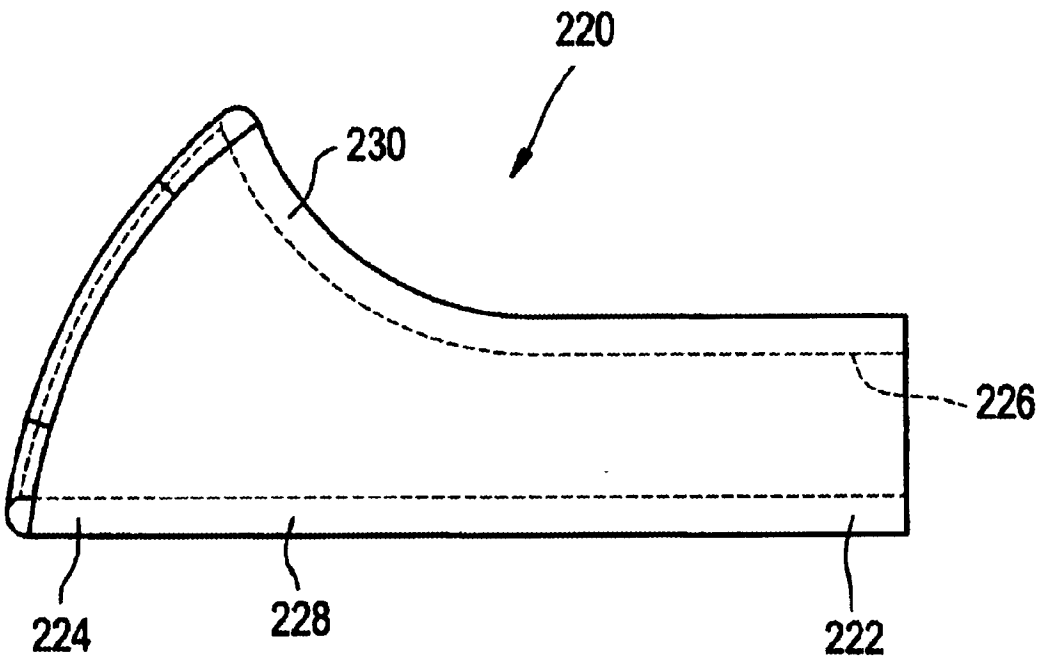
FIG. 6 is a cross-sectional side view of the hose guard illustrated in FIG. 5.

As illustrated in FIG. 5, the hydraulic punch 10 can include a hose guard 220 for protecting the hose 16 from damage caused by impacts and sharp objects, and for preventing the hose 16 from being overflexed, i.e., beyond an angle of 90 degrees relative to the pump section 14.

The hose guard 220 is preferably formed from cast aluminum and is in the form of an irregular shaped tube. The hose guard 220 has a first end 222 and a second end 224 and a bore 226 provided therethrough.

The first end 222 of the hose guard 220 is of a generally cylindrical shape and is proximate to an outer surface of the end wall 90 of the spring retainer 66 of the ram section 12 of the hydraulic punch 10, with the hose 16 proximate to the spring retainer 66 being encapsulated within the bore 226 of the hose guard 220.

The second end 224 of the hose guard 220 is positioned proximate to the pump section 14 and includes a first portion 228 and a second portion 230. The first portion 228 is generally cylindrical while the second portion 230 flares radially outwardly from the first portion 228. The second portion 230 flares to an angle such that when the hose 16 is positioned within the bore 226 of the hose guard 220, the hose 16 can be flexed from between 0 and 90 degrees relative to the pump section 14 of the hydraulic punch 10.

The bore 226, proximate to the first end 222 of the hose guard 220, has a minimum diameter that is greater than or equal to an outside diameter of the hose 16, such that the hose 16 can be positioned within the bore 226 of the hose guard 220. The hose 16 is preferably snugly fit within the bore 226 of the hose guard 220 proximate to the first end 222 thereof, but the hose 16 can also be loosely fit within the bore 226 of the hose guard 220 proximate to the first end 222 thereof.

The bore 226, proximate to the second end 224 of the hose guard 220, has a general diameter that is greater than the outside diameter of the hose 16 because of the second portion 230 of the second end 224 which flares radially outwardly, thus, allowing the hose 16 to be positioned within the bore 226 of the hose guard 220 proximate to the second end 224. As the second portion 230 of the second end 224 of the hose guard 220 flares radially outwardly, the hose 16 is permitted to flex at an angle between 0 and 90 degrees relative to the pump section 14.

Alternatively, the hose 16 could be surrounded by a flexible, spongy, foam material to protect it from damage.

Operation of the hydraulic punch 10 is as follows. The hydraulic punch 10 starts in its rest position where the pump handle 120 is generally parallel to the housing 190, see FIG. 2. An operator drills a small hole into sheet metal, or for instance, an electrical cabinet. The operator then inserts a first end of an externally threaded draw stud (not shown) into the cavity 80 of the first portion 54 of the ram 50 and attaches the first end of the draw stud to the first portion 54 of the ram 50 by threading the first end of the draw stud to the first portion 54 of the ram 50. A second end of the draw stud is inserted through a punching die (not shown) and then through the small hole drilled in the electrical cabinet. The operator then threads a punch onto the second end of the draw stud.

With the position of the hydraulic ram portion 12 now being set with the connection of the draw stud to both the first portion 54 of the ram 50 and the punch 10, on the opposite side of the electrical cabinet, the operator can move the hydraulic pump section 14 to any place desirable as the flexible hydraulic hose 16 allows for this movement. If a hose guard 220 is utilized, the hose guard 220 limits the movement of the flexible hydraulic hose 16 to an angle between 0 and 90 degrees relative to the pump section 14.

The operator can further move the pump handle 120 to any desirable position as the pump block 122, reservoir handle 118 and pump handle 120 can be rotated 360 degrees about the ram coupler 108 as the ram coupler 108 is rotatably retained to the pump block 122 by the retaining plate 138. Thus, regardless of the positioning of the hydraulic ram section 12 and of the flexible hydraulic hose 16, the operator can move the pump handle 120 to a comfortable position to allow for the easy pumping of the pump handle 120 by rotating the pump handle 120, the reservoir handle 118 and the pump block 122. The ram coupler 108 is sealed to the pump block 122 by the O-ring 132 and the ring 134.

Once the operator has the hydraulic pump section 14 in the desired position with both the flexibleness of the hydraulic hose 16 and the ability to rotate the pump handle 120 360 degrees about the ram coupler 108, the operator raises the pump handle 120 to a position where the pump handle 120 is generally perpendicular to the housing 190 (not shown). By raising the pump handle 120, the plunger 180 is forced upward within the bore 178 thus drawing balls 150, 160 toward it. By drawing ball 150 toward the bore 178, ball 150 abuts against the first shoulder 152 of the pump block 122, thereby sealing the axial bore 126. By drawing ball 160 toward the bore 178, ball 160 unseals itself from the seat 164 and pushes against flexible the retaining ring 156, thereby allowing hydraulic fluid to flow from the reservoir in the bladder 176, through the axial bore 168 of the oil filter 170, through the axial bore 166 of the seat 164 and into the axial bore 126 and the bore 178 of the pump block 122.

When the operator forces the pump handle 120 back down to a position such that it is parallel with the reservoir handle 118, the plunger 180 is forced down through the bore 178 of the pump block 122. The pressure produced by such movement of the plunger 180 forces the ball 160 to abut and seal against the seat 164. The pressure produced by such movement of the plunger 180 also overcomes the spring force of spring 144, thus forcing the ball 150 to compress the spring 144 and move away from, and break the seal with, the first shoulder 152 of the pump block 122. With the ball 160 being sealed against the seat 164 and the ball 150 being unsealed against the first shoulder 152 of the pump block 122, the hydraulic fluid in the axial bore 126 and the bore 178 of the pump block 122 is forced past the ball 150, into the axial bore 110 of the ram coupler 108, into the axial bore 40 of the second hydraulic hose connector 34, into the axial bore 18 of the hydraulic hose 16, into the axial bore 32 of the first hydraulic hose connector 26, into the radial bore 86 of the central body 52 of the ram 50, and finally into the first chamber 62, thus pressurizing the first chamber 62.

This action is repeated by the operator until the pressure in the first chamber 62 becomes greater than the spring force of the normally expanded spring 98. Once this occurs, the ram 50 slides within the hydraulic ram section 12, thereby moving the first portion 54 into the first chamber 62. When the first portion 54 moves into the first chamber 62, the size of the first chamber 62 increases, the size of the second chamber 64 decreases, and the normally expanded spring 98 compresses. Because the ram 50 slides within the hydraulic ram section 12, the draw stud moves, thus pulling the punching die and the punch. Because the punch is pulled, while the electrical cabinet is not, the punch creates a hole in the electrical cabinet corresponding to the outline of the punch.

When this hole has been punched, the hydraulic fluid is delivered in the opposite direction back to the bladder 176 by delivery circuit means, which are well known and not described here, except that such operation is effected by the release knob 124. The punch, punching die and draw stud are then all removed from the hydraulic punch 10 prior to the next operation.

While a preferred embodiment of the present invention is shown and described, it is envisioned that those skilled in the art may devise various modifications without departing from the spirit and scope of the foregoing description.

The invention is claimed as follows:

1. A hydraulic punch comprising:

a hydraulic ram section, said hydraulic ram section including, a housing having a passageway extending therethrough;

a ram positioned within said passageway of said housing, said ram capable of sliding within said passageway of said housing, said ram dividing said passageway of said housing into a first chamber and a second chamber, said ram having a bore therethrough which extends from said first chamber to said second chamber;

a retainer connected to said housing for closing an end of said passageway, said retainer having an opening therethrough; and a normally expanded spring positioned within said second chamber between said ram and said retainer;

a hydraulic pump section; and an elongated flexible hydraulic hose connected between said hydraulic ram section and said hydraulic pump section, said elongated flexible hydraulic hose permitting movement of said hydraulic ram section relative to said hydraulic pump section.

2. A hydraulic punch as defined in claim 1, wherein said hydraulic pump section can be rotated 360 degrees about said elongated flexible hydraulic hose.

3. A hydraulic punch as defined in claim 1, wherein said hydraulic pump section includes a reservoir for storing hydraulic fluid, said hydraulic fluid capable of moving from said reservoir of said hydraulic pump section, through said hydraulic pump section, through said elongated flexible hydraulic hose, and into said hydraulic ram section.

4. A hydraulic punch as defined in claim 1, wherein said ram has a cavity therein for connection of a draw stud thereto.

5. A hydraulic punch as defined in claim 1, wherein said bore extending through said ram has a first portion which is aligned with a central axis of said ram and a second portion which is radial to said central axis of said ram.

6. A hydraulic punch comprising:

a hydraulic ram section;

a hydraulic pump section, said hydraulic pump section including, a pump block having a first bore extending therethrough, and a second bore extending at an angle to said first bore;

a plunger housed within said second bore of said pump block;

a first handle having a reservoir therein for storing hydraulic fluid, said reservoir being in communication with said first bore of said pump block such that said hydraulic fluid can move into said first bore of said pump block; and a second handle attached to said plunger and to said pump block, said second handle capable of being moved from a first position to a second position in order to move said plunger within said second bore of said pump block, said movement of said plunger within said second bore of said pump block causing said hydraulic fluid to move from said reservoir to said first bore of said pump block; and an elongated flexible hydraulic hose connected between said hydraulic ram section and said hydraulic pump section, said elongated flexible hydraulic hose permitting movement of said hydraulic ram section relative to said hydraulic pump section.

7. A hydraulic punch as defined in claim 6, wherein said hydraulic pump section further includes a coupler attached to said pump block, said coupler being attached to said elongated flexible hydraulic hose.

8. A hydraulic punch as defined in claim 7, wherein said hydraulic pump section further includes a plate securing said coupler to said pump block.

9. A hydraulic punch as defined in claim 8, wherein said pump block can be rotated 360 degrees about said coupler.

10. A hydraulic punch as defined in claim 6, wherein said hydraulic ram section is capable of being rotated from 0 degrees to an angle greater than 90 degrees relative to said hydraulic pump section as said elongated flexible hydraulic hose is capable of bending from 0 degrees to an angle greater than 90 degrees.

11. A hydraulic punch comprising:

a hydraulic ram section;

a hydraulic pump section;

an elongated flexible hydraulic hose connected between said hydraulic ram section and said hydraulic pump section, said elongated flexible hydraulic hose permitting movement of said hydraulic ram section relative to said hydraulic pump section; and a hose cover, said elongated flexible hydraulic hose being generally encapsulated within said hose cover, said hose cover prevents said elongated flexible hydraulic hose from being flexed at an angle greater than approximately 90 degrees relative to said hydraulic pump section such that said hydraulic ram section cannot move more than 90 degrees relative to said hydraulic pump section.

12. A hydraulic punch comprising:

a hydraulic ram section;

a hydraulic pump section;

flexible means for connecting said hydraulic ram section and said hydraulic pump section, said flexible connecting means permitting movement of said hydraulic ram section relative to said hydraulic pump section; and means for protecting said flexible connecting means from damage, said protecting means is a hose cover, said elongated flexible hydraulic hose being generally encapsulated within said hose cover, said hose cover preventing said flexible connecting means from flexing to an angle greater than 90 degrees relative to said hydraulic pump section.

13. A hydraulic punch as defined in claim 12, wherein said hydraulic pump section can be rotated 360 degrees about said flexible connecting means.

14. A hydraulic punch as defined in claim 12, wherein said flexible connecting means is an elongated flexible hydraulic hose.

15. A hydraulic punch as defined in claim 14, further including a first hydraulic hose connector at an end of said elongated flexible hydraulic hose and connected to said hydraulic ram section, a second hydraulic hose connector connected to an opposite end of said elongated flexible hydraulic hose, and said hydraulic pump section including a coupler connected to said second hydraulic hose connector.

16. A hydraulic punch as defined in claim 12, wherein said hydraulic pump section includes a reservoir for storing hydraulic fluid, said hydraulic fluid capable of moving from said reservoir of said hydraulic pump section, through said hydraulic pump section, through said flexible connecting means, and into said hydraulic ram section.

17. A hydraulic punch as defined in claim 12, wherein said hydraulic ram section is capable of being rotated from 0 degrees to an angle greater than 90 degrees relative to said hydraulic pump section as said flexible connecting means is capable of bending from 0 degrees to an angle greater than 90 degrees.

18. A hand-held hydraulic punch comprising:

a hydraulic ram section;

a hydraulic pump section;

an elongated flexible hydraulic hose connected between said hydraulic ram section and said hydraulic pump section, said elongated flexible hydraulic hose permitting movement of said hydraulic ram section relative to said hydraulic pump section, wherein a user can carry said hydraulic ram section and said hydraulic punch section; and a hose cover, said elongated flexible hydraulic hose being generally encapsulated within said hose cover.

19. A hand-held hydraulic punch as defined in claim 18, wherein said hose cover prevents said elongated flexible hydraulic hose from being flexed at an angle greater than approximately 90 degrees relative to said hydraulic pump section such that said hydraulic ram section cannot move more than 90 degrees relative to said hydraulic pump section.

* * * * *